US005936827A

United States Patent [19]

Dressler et al.

[11] Patent Number: 5,936,827

[45] Date of Patent: Aug. 10, 1999

[54] DEVICE FOR CONTROLLING AT LEAST ONE ELECTROMAGNETIC LOAD

[75] Inventors: Klaus Dressler, Löchgau; Rainer Burkel, Asperg; Engelbert Tillhon, Lauffen; Andreas Werner, Reichenbach; Wilhelm Eyberg, Leonberg; Andreas Koch, Bietigheim-Bissingen; Udo Schulz, Vaihingen; Wolfgang Krampe, Renningen, all of Germany

[73] Assignee: Robert Bosch GmbH, Stuttgart, Germany

[21] Appl. No.: 08/894,803

[22] PCT Filed: Feb. 2, 1996

[86] PCT No.: PCT/DE96/00160

§ 371 Date: Sep. 2, 1997

§ 102(e) Date: Sep. 2, 1997

[87] PCT Pub. No.: WO96/27198

PCT Pub. Date: Sep. 6, 1996

[30] Foreign Application Priority Data

Mar. 2, 1995 [DE] Germany ..... 195 07 222
Oct. 20, 1995 [DE] Germany ..... 195 39 071

[51] Int. Cl.[6] ..... H01H 9/00

[52] U.S. Cl. ..... 361/154; 361/155

[58] Field of Search ..... 361/143, 152–156; 123/490; 251/234–239

[56] References Cited

U.S. PATENT DOCUMENTS

| | | | |
|---|---|---|---|
| 4,862,866 | 9/1989 | Calfus | 123/490 |
| 4,933,805 | 6/1990 | Calfus | 361/152 |
| 4,950,974 | 8/1990 | Pagano | 323/222 |
| 5,532,526 | 7/1996 | Ricco et al. | 307/104 |
| 5,621,604 | 4/1997 | Carlson | 361/166 |
| 5,729,422 | 3/1998 | Henke | 361/156 |

*Primary Examiner*—Jeffrey Gaffin
*Assistant Examiner*—Kim Huynh
*Attorney, Agent, or Firm*—Kenyon & Kenyon

[57] ABSTRACT

A device for controlling at least one electromagnetic load, which includes a first switching device arranged between a first terminal of a supply voltage and a first terminal of at least one load, and a second switching device arranged between a first terminal of an assigned load and the second terminal of the supply voltage. The energy released during the transition from a first higher current (IH) to a second lower current (IH) is stored in a storage device.

11 Claims, 4 Drawing Sheets

AC

AH

AL

AS

I
IA
IH

U
US
0 1 2 3 4a 4b 5 8

DEVICE FOR CONTROLLING AT LEAST ONE ELECTROMAGNETIC LOAD

FIELD OF THE INVENTION

The present invention relates to a device for controlling at least one electromagnetic load.

BACKGROUND INFORMATION.

Such a device for controlling an electromagnetic load is described in German Patent application No. 44 13 240 (not a prior publication). In this device, the energy released when shutting off the device is stored in a capacitor. The energy released during the transition from a holding current to 0 current is transferred to a capacitor.

The energy released during the transition from starting current to holding current is lost in this device.

SUMMARY OF THE INVENTION

The object of the present invention is to provide a device of a relatively simple construction for controlling an electromagnetic load in order to speed up the switching-on process and minimize the overall power consumption.

The device according to the present invention offers the advantage that the energy released during the transition from starting current to holding current can be recovered. A particularly advantageous embodiment also allows two loads to be controlled in different ways with the same output element. This means that injections overlapping in time are possible.

DETAILED DESCRIPTION OF THE INVENTION

The device according to the present invention is preferably used in internal combustion engines, in particular in self-igniting internal combustion engines. In these machines, fuel delivery is controlled using electromagnetic valves, hereinafter referred to as "loads." The present invention is not limited to such application, but can be used wherever quick-switching electromagnetic loads are needed.

When used in internal combustion engines, in particular in self-igniting internal combustion engines, the times of opening and closing of the solenoid valves determine the fuel injection start and injection end, respectively, into the cylinder.

Figure 1:
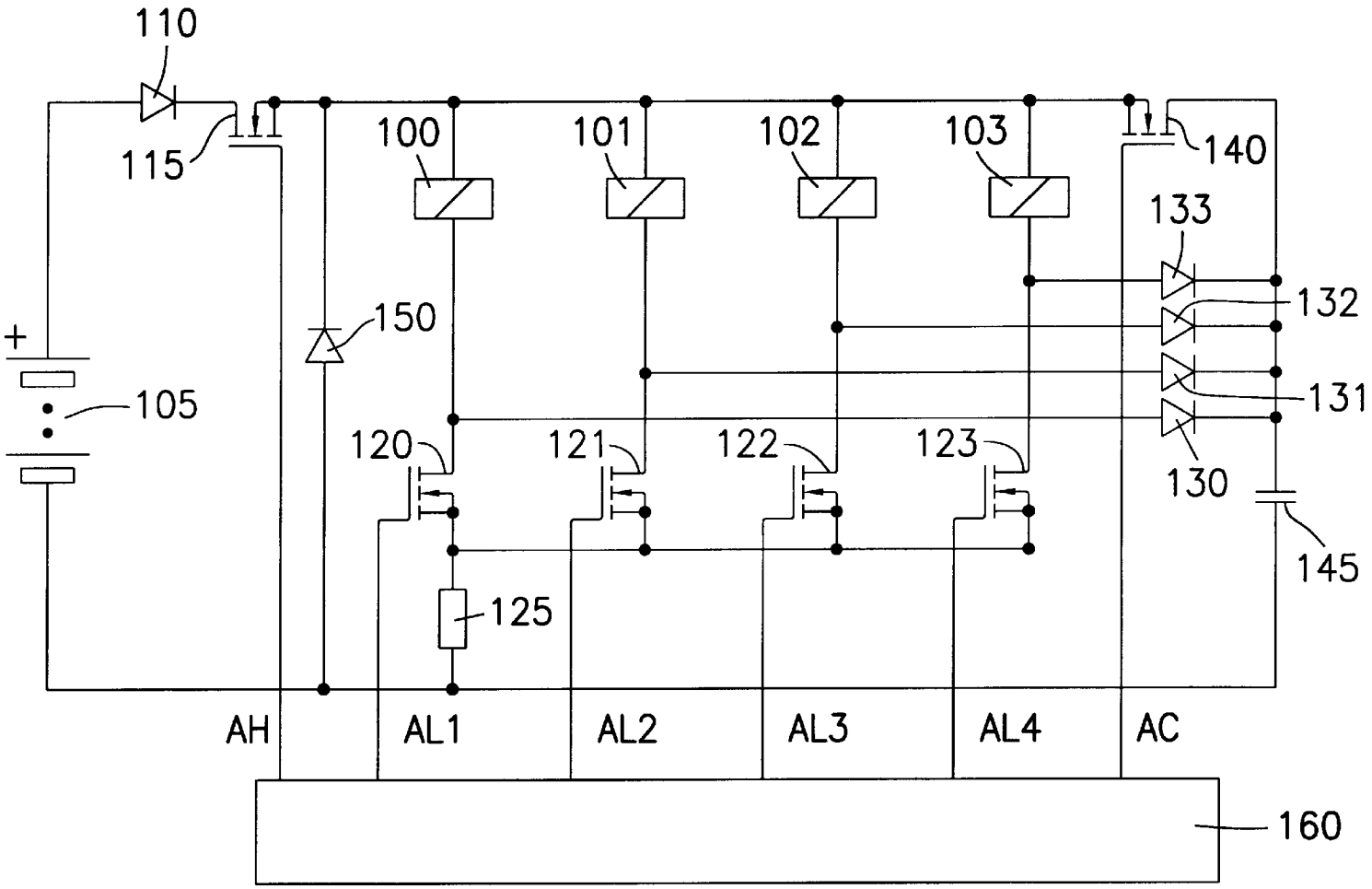
FIG. 1 shows a first circuit arrangement of the device according to the present invention.

FIG. 1 shows the essential elements of the device according to the present invention. The illustrated embodiment is a four-cylinder internal combustion engine, where an injection valve is assigned to each load and a cylinder of the internal combustion engine is assigned to each injection valve. When more engine cylinders are present, more valves, switching means, and diodes are to be provided accordingly.

Four loads are denoted as 100, 101, 102, and 103. Each terminal of loads 100 through 103 is connected to a voltage supply 105 through a first switching means apparatus 115 and a diode 110.

Diode 110 is configured so that its anode is connected to the positive pole and its cathode is connected to first switching means 115. Switching means 115 is preferably a field-effect transistor.

The second terminal of each load 100 through 103 is connected to a resistor means (element) 125 via a second switching means (devices) 120, 121, 122, and 123. Second switching means 120 through 123 can be field-effect transistors. Second switching means 120 through 123 can also be referred to as low-side switches, and first switching means 115 is referred to as a high-side switch. The second terminal of resistor means 125 is connected to the second terminal of the voltage supply 105.

Each load 100 through 103 is assigned a diode 130, 131, 132, and 133. Each anode terminal of the diodes is in contact with the connection point between load and low-side switch. The cathode terminal is connected to a capacitor 145 and a third switching means (device) 140. The second terminal of third switching means 140 is in contact with the first terminals of loads 100 through 103. Third switching means 140 can preferably be a field-effect transistor. Third switching means 140 can be a booster switch. The second terminal of capacitor 145 is also connected to voltage supply 105.

High-side switch (first switching means) 115 receives a control signal AH from a controller 160. Switching means 120 receives a control signal AL1 from controller 160, switching means 121 receives control signal AL2, switching means 122 receives control signal AL3, switching means 123 receives control signal AL4, and switching means 140 receives control signal AC.

A diode 150 is connected between the second terminal of voltage supply 105 and the connection point between switching means 115 and the first terminals of loads 100 through 103. The anode of the diode is connected to the second terminal of voltage supply 105.

The current flowing through the load can be determined using resistor 125.

The current through the current measuring resistor 125 can only be measured with the arrangement described if one of second switching means 120 through 123 is closed. In order to also measure the current with open low-side switches, the current measuring resistor can also be arranged at a different point. For example, the second terminal of capacitor 145 can be connected to the point of connection between current measuring means 125 (resistor) and switching means 120 through 123. In this case, current can also be measured with non-conducting low-side switches. Furthermore, the current measuring means can also be arranged between the voltage supply 105 and the high-side switch or between the high-side switch and the loads.

Figure 2:
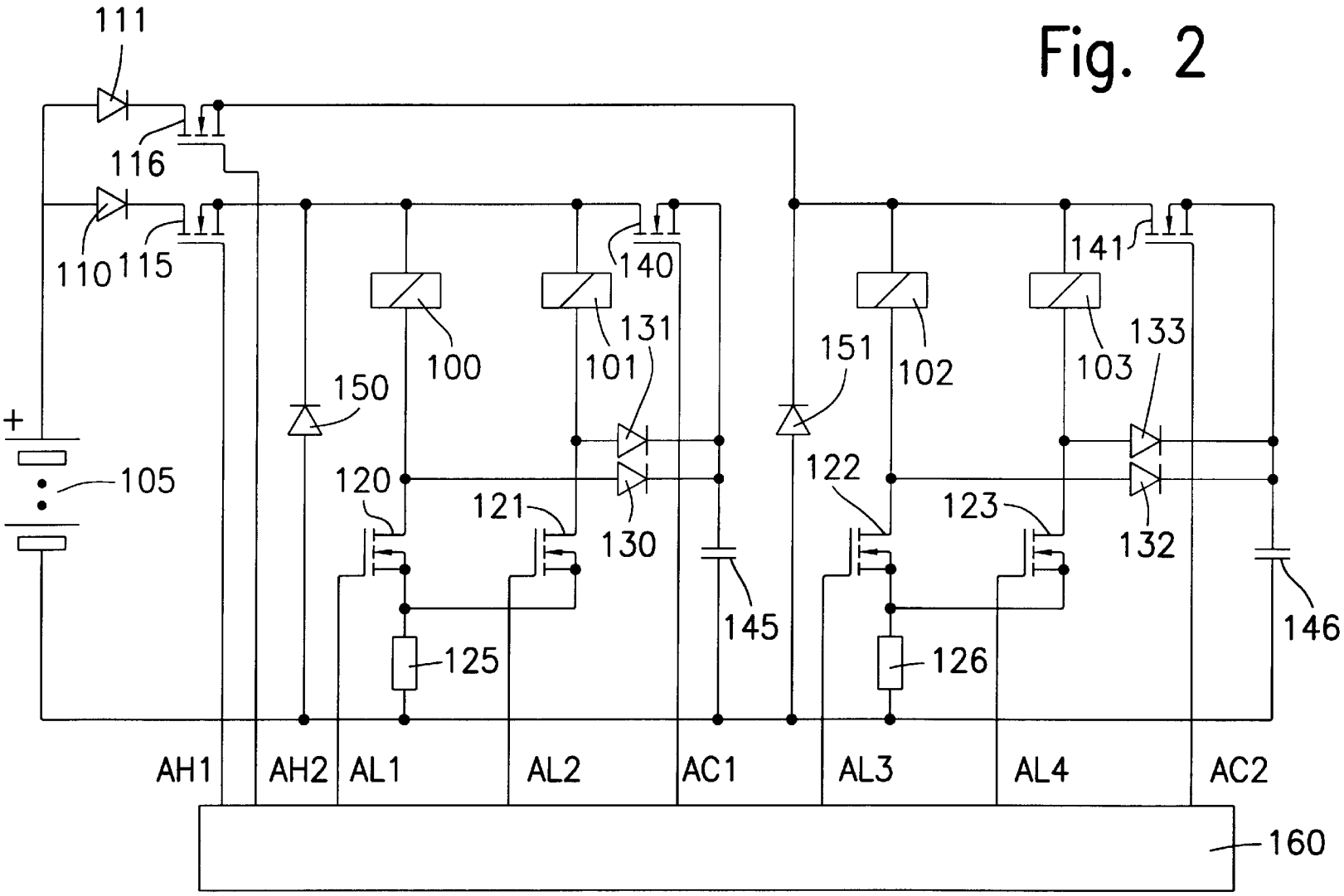
FIG. 2 shows a second circuit arrangement of the device according to the present invention.

FIG. 2 shows another device according to the present invention where loads 100 through 103 are divided into two groups. Loads 100 and 101 form a first group, and loads 102 and 103 form a second load group. The loads are assigned to the individual groups so that loads to be activated at the same time under certain operating conditions are assigned to different groups.

Elements already described in FIG. 1 have the same notation in FIG. 2. A high-side switch 115 and 116 is provided for each group. Diode 111 corresponds to diode 110 of the first group. Similarly, a duplicate of booster transistor 140 is provided. The booster transistor of the second group is denoted as 141. Similarly, capacitor 145 of the second group is denoted as 146. Furthermore, two additional control lines are provided for switching means 116 and 141. High-side switch 115 of the first group receives signal AH1. High-side switch 116 of the second group receives signal AH2. Booster switch 140 of the first group receives signal AC1 and booster switch 141 of the second group receives signal AC2. There are also two resistors, one for the first group being denoted as 125, the one of the second group being denoted as 126.

Figures 3A, 3B, 3C, 3D, 3E:
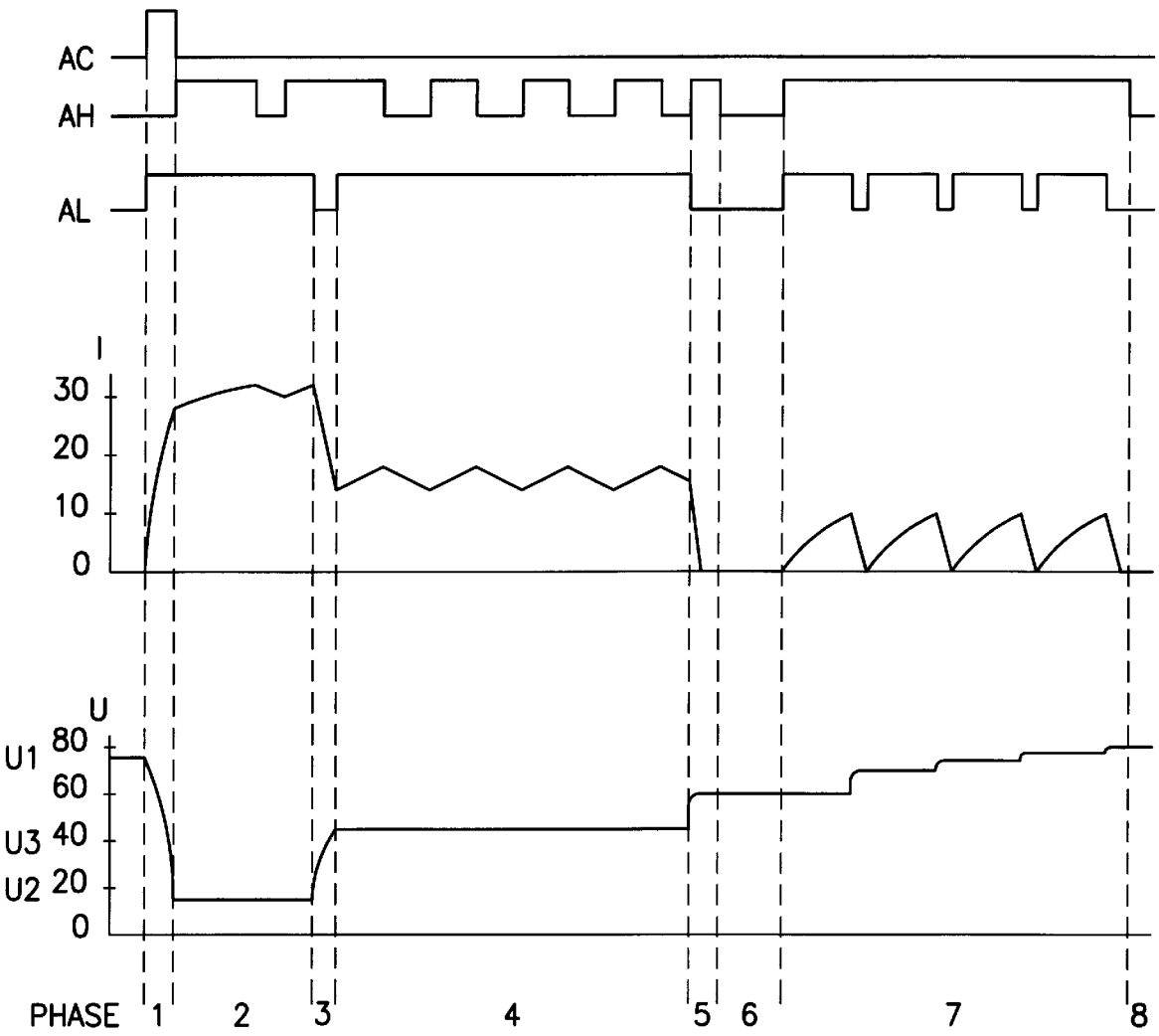
FIG. 3*a* shows a control signal AC plotted over time.
FIG. 3*b* shows a control signal AH plotted over time.
FIG. 3*c* shows a control signal AL plotted over time.
FIG. 3*d* shows a graph of a current I flowing through a load plotted over time.
FIG. 3*e* shows a graph of a voltage UC applied to a capacitor plotted over time.

FIG. 3*a* shows the control signal AC for booster transistors 140 and 141. FIG. 3*b* shows the control signal AH for high-side switches 115, 116. FIG. 3*c* shows the control signal AL of one of the low-side switches. FIG. 3*d* shows current I flowing through the load, and FIG. 3*e* shows the variation over time of voltage UC applied to capacitor 145. These figures show one delivery cycle for a solenoid valve.

In each delivery cycle, different phases can be distinguished. In a phase 0, before the load is activated, the output element is turned off. Control signals AC, AH, and AL are on a low potential. This means that high-side switch 115, low-side switches 120 through 123, and booster switch 140 block the current flow. No current flows through the load. Capacitor 145 is charged to its maximum voltage UC, which may have a value of 80 V, for example, whereas the voltage of the voltage supply has a value of approximately 12 V.

In the first phase at the beginning of the control, which is referred to as booster operation, the low-side switch, assigned to the load that is to deliver fuel, is activated. This means that starting with phase 1, signal AL assumes a high level. At the same time, a high signal is emitted on line AC, which activates switch (third switching means) 140. High-side switch 115 is not activated; it continues to block the current. Activating the third switching means 140 causes current to flow from capacitor 145 through booster switch 140, the corresponding load, the low-side switch assigned to the load, and current measuring means 125. In this phase current I increases rapidly due to the high voltage at the load. Phase 1 ends when the voltage applied to capacitor 145 drops below a certain value U2.

In the second phase, referred to as starting current regulation, the starting current goes through high-side switch 115, and the booster is de-activated. In the second phase the control signal for booster switch 140 is canceled, so that switch 140 blocks the current. Control signals AH and AL for high-side switch 115 and the low-side switch assigned to the load are set to a high level, so these switches will let the current through. Thus a current flows from voltage supply 105 through diode 110, high-side switch 115, the load, the corresponding low-side switch, current measuring resistor 125, and back to voltage supply 105. By timing the high-side switch, the current measured by current measuring resistor 125 can be maintained at a preset level for starting current IA. This means that when the starting current reaches the setpoint IA, high-side switch 115 is activated so that it blocks the current. When the starting current drops below another threshold, the current is let through again.

When the high-side switch 115 is in the blocking position, the circuit acts as a free-wheeling circuit. The current flows from the load through the low-side switch, resistor 125, and free-wheeling diode 150.

The second phase ends when the end of the starting phase is detected by controller 160. This can be the case, for example, when a switching point detector detects that the solenoid valve armature has reached its new end position. If the switching point detector does not detect, within a predefined time, that the solenoid valve armature has reached its new end position, an error is detected.

In the third phase, which is also known as the first quick-extinction, the control signal is canceled for the corresponding low-side switch. This causes a current to flow from the corresponding load through the diode 130 through 133 assigned to that load into capacitor 145, and the energy stored in the load is charged into capacitor 145. In the embodiment illustrated, high-side switch 115 is activated so that it remains closed. In this phase, the current drops from starting current IA to holding current IH. At the same time, the voltage applied to capacitor 145 rises to a value U3, which however is clearly below U1. The third phase ends when setpoint IH for the holding current is reached. The energy released during the transition from starting current IA to holding current IH is stored in the capacitor. Especially advantageous here is that the transition from starting current to holding current occurs rapidly due to the quick extinction.

The third phase is followed by the fourth phase, which is also referred to as holding current regulation. As in the second phase, the control signal for the low-side switch remains at its high level, i.e., the low-side switch assigned to the load remains closed. The current flowing through the load is regulated to its setpoint for the holding current by opening and closing high-side switch 115. When high-side switch 115 is non-conducting, the circuit operates as a free-wheeling circuit. The current flows from the load through the low-side switch, resistor 125, and free-wheeling diode 150. Phase 4 ends when the injection process is completed.

During the subsequent fifth phase, also known as the second quick extinction or quick extinction check, the corresponding low-side switch is turned off, and high-side switch 115 is made conductive. In this phase the current flowing through the load also quickly drops to zero. At the same time, voltage U applied to capacitor 145 rises to a value that is less than that in the third phase.

In the third and fifth phases, the setpoint for current I goes from a higher to a lower value. In these phases the low-side switch assigned to the load is activated so that it blocks the current flow. The energy released is stored in capacitors 145, 146. Quick extinction takes place in these phases. It causes the current to quickly reach its new setpoint.

In the second and fourth phases, current is regulated by timing the high-side switch. When the high-side switch is in the blocking position, free-wheeling diode 150 is active. In these phases the current drops slowly, which results in a lower switching frequency.

In the sixth phase the output element is inactive, i.e., no fuel delivery takes place. This means that control signal AC for booster switch 140, control signal AH for the high-side switch, and control signal AL for the low-side switches all assume a low level, and all switches go to the blocking position. The current flowing through the load remains at 0 and the voltage at capacitor 145 remains at its value.

In the seventh phase after activation, which is also referred to as post-timing, high-side switch 115 is brought to its conducting state again by control signal AH. A current flow is initialized in one of the loads by closing a low-side switch. The current flows, for example, through diode 110, switch 115, load 100, switching means 120, and current measuring means 125 back to the voltage source. When a setpoint for the current, selected so that the solenoid valve still will not react, is reached, the low-side switch is activated so that it opens. This causes quick extinction on the current path comprising the load, one of diodes 130 through 133, and capacitor 145. Therefore the voltage applied to capacitor 145 increases. As soon as the current reaches its zero value again, low-side switch 120 is reactivated. This procedure is repeated until the voltage at capacitor 145 reaches U1stepwise again.

Phase 8 follows, in which all control signals are canceled and all switches are brought to their blocking state. This phase corresponds to phase 0.

If only one injection interval is provided for each cylinder and each delivery cycle, no problems occur in a device according to FIG. 1. If, however, pre-injection is provided prior to the main injection proper or post-injection is provided after the main injection proper, the solenoid valves of two cylinders may have to be activated at the same time. Particularly the main injection and pre-injection of the following cylinder or the post-injection and the pre-injection of the following cylinder may overlap in time. For a circuit arrangement according to FIG. 1 this may result in two loads being selected through the low-side switches, while only one common current regulation is possible using high-side switch 115. Two valves cannot be activated in different ways at the same time. It is, for example, not possible to regulate the current to the holding current for one solenoid valve and to the starting current for another solenoid valve. Furthermore, capacitor 145 must be charged prior to activating the next valve. If the switch-off points and the switch-on point of two solenoid valves follow one another very closely, capacitor 145 cannot be charged.

Such a control, where two solenoid valves are energized at the same time with different currents and capacitor 145 is charged is possible, however, with a device according to FIG. 2. In this arrangement, the loads are divided into two groups. A high-side switch 115, 116, a booster switch 140, 141, a measuring resistor 125, 126, and a capacitor 145, 146 is assigned to each group of loads. Either group of loads can be selected using the respective high-side switch 115 or 116. The device according to the present invention also provides for the loads to be assigned to different groups assigned to cylinders into which fuel is delivered consecutively.

The device according to the present invention is illustrated using the example of an internal combustion engine with four cylinders. The procedure can, however, be also used for internal combustion engines with a different number of cylinders by providing the corresponding number of loads, switching means, and other elements. The loads can also be divided into a larger number of groups. This is particularly advantageous for a higher number of cylinders.

In the embodiment described above, transition from a high current level to a lower current level takes place after the current regulating phase, with part of the stored electric energy being used to partially charge the capacitor. Further charging of the capacitor takes place at the end of the activation during the quick extinction of the load current. If, after this phase, the capacitor charge is still insufficient for switching on again, further increase in the voltage is achieved through periodically switching the load current on and off (post-timing) between two injections and storing the electric energy.

A high engine rpm causes the time period during which the voltage can be increased through post-timing to become shorter. At a high rpm, it is not possible to step up the voltage during the time between two injections, so that the capacitor cannot be charged to the required voltage.

Therefore, another embodiment is proposed according to the present invention, wherein voltage is stepped up earlier during the current regulating phase, and the capacitor is fully loaded again during activation. Thus post-timing can be omitted in the activation window. Furthermore, the risk of an undesirable injection occurring is reduced, since no current flows through the load between two injections.

Figures 4A, 4B, 4C, 4D, 4E, 4F:
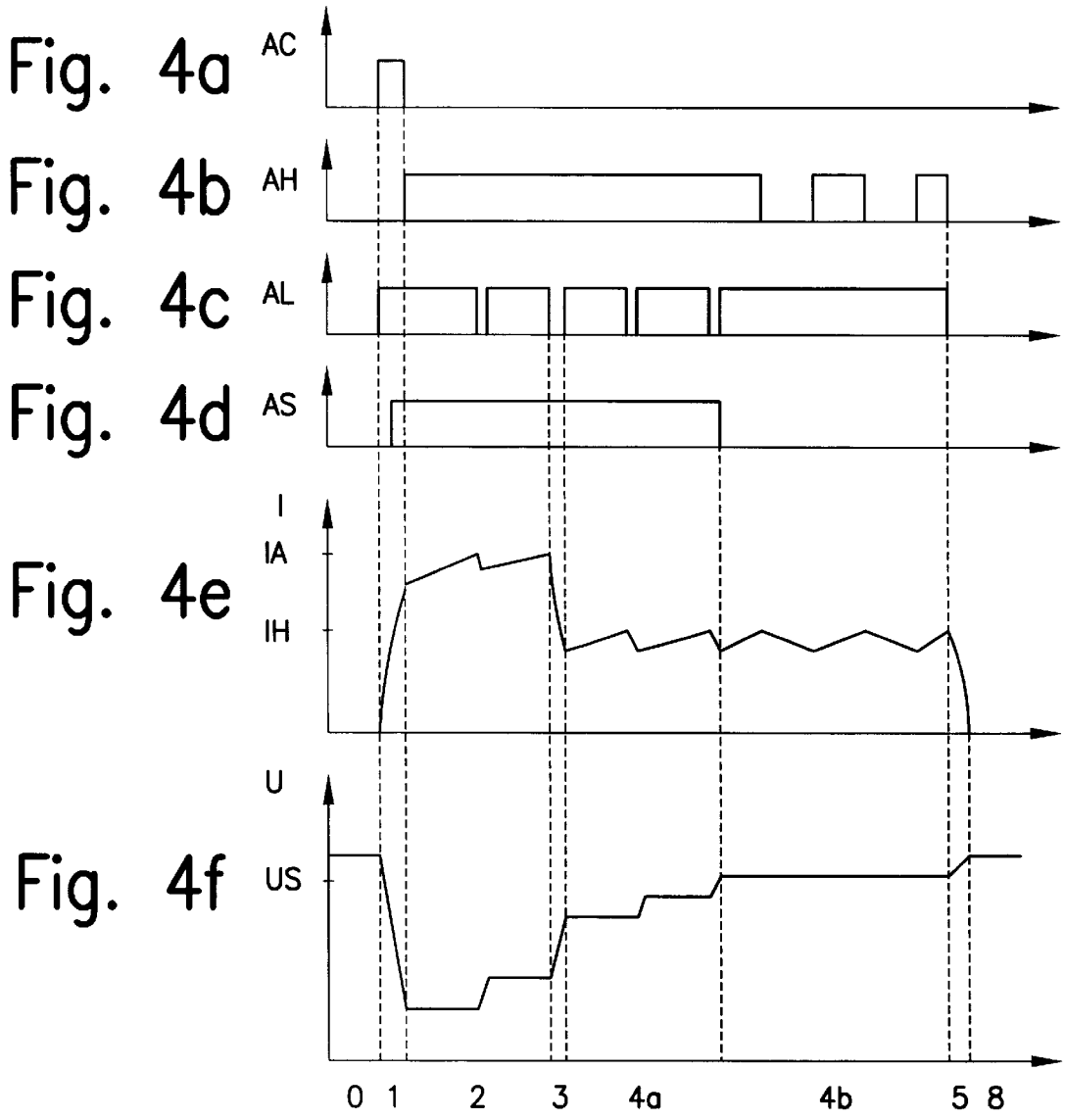
FIG. 4*a* shows a control signal AC plotted over time for another embodiment according to the present invention.
FIG. 4*b* shows a control signal AH plotted over time for another embodiment according to the present invention.
FIG. 4*c* shows a control signal AL plotted over time for another embodiment according to the present invention.
FIG. 4*d* shows a signal AS plotted over time for the charge status of the capacitor another embodiment according to the present invention.
FIG. 4*e* shows a graph of a current I flowing through a load plotted over time for another embodiment according to the present invention.
FIG. 4*f* shows a graph of a voltage UC applied to a capacitor plotted over time for another embodiment according to the present invention.

FIG. 4 shows, as does FIG. 3, the control signals AC for the booster transistor 141; FIG. 4*b* shows the control signal AH for the high-side switch; FIG. 4*c* shows the control signal AL of a low-side switch; FIG. 4*d* shows a signal AS that takes into account the charge status of the capacitor; FIG. 4*e* shows current I flowing through the load; and FIG. 4*f* shows voltage U applied to the capacitor over time.

As also shows in the control process illustrated in FIG. 3, different phases are distinguished. In a phase 0, which precedes the activation of the load, the output element is switched off. Control signals AC, AH, AL and the AS signal are at a low potential. This means that high-side switch 115, low-side switches 120–123, and booster switch 140 block the current flow. No current flows through the load. Capacitor 145 is charged to its maximum voltage U10, which assumes a value of approximately 80 V, while the voltage supply has an approximate value of 12 V.

The first phase at the beginning of the activation corresponds to the first phase of the procedure according to FIG. 3. During phase 1, signal AS increases to its high level. This shows that the voltage applied to the capacitor is less than a predefined threshold value US.

In the second phase, which can also be referred to as starting current regulation, the starting current flows to high-side switch 115, and the booster 140 is de-activated. This means that, in the second phase, control signal AC for booster switch 140 is canceled so that switch 140 blocks the current. Control signals AH and AL for high-side switch 115 and the low-side switch assigned to the load assume a high level, so these switches let the current flow through. Thus a current flows from voltage supply 105 through diode 110, high-side switch 115, the load, the corresponding low-end switch, current measuring resistor 125, and back to voltage supply 105.

In contrast to phase 2 according to FIG. 3, the current measured using current measuring resistor 125 is regulated to a predefinable value for starting current IA. This means that when setpoint IA for the starting current is reached, low-side switch 120 through 125 is activated so that it blocks the current. When the current drops below another threshold value, it is let through again. As a result, when low-side switch 120 through 125 is open, a current flows from the respective load through diode 130 through 133 assigned to the load into capacitor 145 and the energy stored in the load is loaded into capacitor 145. At the same time, voltage U applied to capacitor 145 increases.

The second phase ends when controller 160 detects the end of the starting phase. This can be the case, for example, when a switching point detector detects that the solenoid valve armature has reached its new end position.

In the third phase, which is also known as the first quick extinction, the control signal for the respective low-side switch is canceled as in the third phase of the first embodiment. This causes a current to flow from the respective load through diode 130–133 assigned to the load into capacitor 145. The energy stored in the load is charged into capacitor 145. In this phase the current drops from starting current IA to holding current IH. At the same time, the voltage U applied to capacitor 145 increases. The third phase ends when the setpoint for the holding current is reached. The energy released during the transition from starting current to holding current is stored in the capacitor.

The third phase is followed by the fourth phase, which is also referred to as holding current regulation. As in the second phase, the control signal for the high-side switch remains at its high level, i.e., the high-side switch remains closed. When the low-side switch is opened and closed, the current flowing through the load is regulated to the setpoint for the holding current. When the low-side switch is in the blocking position, the current flows from the respective load into capacitor 145 through diode 130–133 assigned to the load. Thus the energy stored in the load is charged into the capacitor.

As soon as the voltage U applied to the capacitor has reached a predefined threshold value US, signal AS changes to a low potential. Thus ends the first part 4*a* of the fourth phase. Starting at this time, current is no longer regulated via the low-side switch, but via the high-side switch. This means that the low-side switch is permanently in its conducting position and the high-side switch toggles between its blocking and open position. When high-side switch 115 is in the blocking position, the circuit operates as a free-wheeling circuit. The current flows from the load through the low-side switch, resistor 125, and free-wheeling diode 150. The fourth phase ends when the injection is completed.

The subsequent fifth phase corresponds to the fifth phase of the process according to FIG. 3. Phases six and seven according to FIG. 3 are not required for this type of control.

As long as signal AS is at its high level, i.e., the voltage at the capacitor has not yet reached its predefined setpoint US, the output element arrangement operates as a current-regulating step-up converter. In this operating state, the high-side switch is permanently conducting. Current is regulated by the low-side switch assigned to the individual loads which is switched periodically on and off to regulate the current.

If the voltage U applied to capacitor 145 has reached a predefined value US, another operating mode begins. In this mode the capacitor is no longer being charged. Current is regulated as in the embodiment of FIG. 3 via the high-side switch.

Threshold value US for the capacitor voltage is preferably selected so that the voltage at the end of phase 4*a*, together with the increase in voltage in the fifth phase, yields a voltage required for quick switching on. In phase 4*a*, the circuit arrangement operates as a step-up converter. Current is regulated in phase 4*b* via the high-side switch.

What is claimed is:

1. A device for controlling at least one electromagnetic load having a first load terminal and a second load terminal, the device comprising:

a first switching apparatus coupled between a first voltage terminal of a voltage supply and the first load terminal of the at least one electromagnetic load;

at least one second switching apparatus, each corresponding to a respective load of the at least one electromagnetic load and coupled between a second voltage terminal of the voltage supply and the second load terminal of the respective load;

a free-wheeling diode coupled between the first load terminal of the at least one electromagnetic load and the second voltage terminal of the voltage supply;

a storage unit for storing released energy; and a controller actuating the at least one second switching apparatus to provide the released energy to the storage unit when a current changes from a starting current value to a holding current value, wherein, during a first phase, when the current is regulated to a predetermined setpoint value, the controller actuates the first switching apparatus to actuate the free-wheeling diode and reduce the current according to a first decay rate, and wherein, during a second phase, when the current changes from the starting current value to the holding current value and the actuation of the at least one second switching apparatus provides the released energy to the storage unit, the current is reduced according to a second decay rate that is greater than the first decay rate.

2. The device according to claim 1, wherein the at least one electromagnetic load includes a solenoid valve for controlling a fuel delivery in an internal combustion engine.

3. The device according to claim 1, further comprising:

a third switching apparatus coupling the first load terminal of the at least one electromagnetic load to the storage unit during the first phase.

4. The device according to claim 3, wherein the at least one electromagnetic load includes a plurality of electromagnetic loads divided into at least two groups, and wherein at least one of the first switching apparatus, the third switching apparatus and the storage unit is assigned to each of the at least two groups.

5. The device according to claim 1, wherein, when the at least one second switching apparatus is opened, the released energy is stored in the storage unit.

6. The device according to claim 1, wherein, when the current changes from the holding current value to zero, the released energy is stored in the storage unit.

7. The device according to claim 1, wherein, when the current is regulated to the predetermined setpoint value, the released energy is stored in the storage unit.

8. The device according to claim 1, wherein, during a phase following an activation of the at least one second switching apparatus, the at least one second switching apparatus is controlled by the controller for a predetermined time period occurring during the phase following the activation of the at least one second switching apparatus to prevent the at least one electromagnetic load from activating and to store the released energy in the storage unit.

9. The device according to claim 1, wherein the storage unit is connected in parallel to the at least one second switching apparatus.

10. The device according to claim 1, further comprising:

a current measuring element coupled between the at least one second switching apparatus and the second voltage terminal of the voltage supply, the current measuring element providing a measurement of a current flowing through the at least one electromagnetic load.

11. The device according to claim 10, wherein the current measuring element includes a resistor.

* * * * *

UNITED STATES PATENT AND TRADEMARK OFFICE

CERTIFICATE OF CORRECTION

PATENT No. : 5,936,827

DATED : August 10, 1999

INVENTOR(S): Klaus Dressler et al.

It is certified that error appears in the above-identified patent and that said Letters Patent is hereby corrected as shown below:

Column 3, line 1, "means 125 (resistor)" should be - -means (resistor) 125 - -; and Column 3, line 27, after " "125" insert - - and - -.

Signed and Sealed this

Twelfth Day of December, 2000

*Attest:*

*Attesting Officer*

Q. TODD DICKINSON

*Director of Patents and Trademarks*